US005885197A

United States Patent [19]

Barton

[11] Patent Number: 5,885,197

[45] Date of Patent: Mar. 23, 1999

[54] EXERCISE EQUIPMENT

[76] Inventor: Jimmy Barton, 108 1/2 S. Main St., Columbiana, Ohio 44408

[21] Appl. No.: 868,909

[22] Filed: Jun. 4, 1997

[51] Int. Cl.[6] ..... A63B 26/00

[52] U.S. Cl. ..... 482/144; 482/145

[58] Field of Search ..... 482/144, 95, 96, 482/142, 130, 907, 145; 601/124, 23, 115; 5/615, 614

[56] References Cited

U.S. PATENT DOCUMENTS

| | | | |
|---|---|---|---|
| 1,693,810 | 12/1928 | Daniels et al. | 482/144 |
| 3,081,085 | 3/1963 | Giralamo | 482/144 |
| 3,388,700 | 6/1968 | Mountz | 482/144 |
| 4,176,836 | 12/1979 | Coyle | 482/96 |
| 4,690,133 | 9/1987 | George | 482/144 |
| 5,169,363 | 12/1992 | Campanaro et al. | 482/142 |
| 5,263,913 | 11/1993 | Boren | 482/142 |
| 5,551,937 | 9/1996 | Kwo | 482/144 |
| 5,674,168 | 10/1997 | Wilkinson | 482/144 |

*Primary Examiner*—Jerome W. Donnelly
*Attorney, Agent, or Firm*—Rudnick & Wolfe

[57] ABSTRACT

Exercise equipment comprising a stationary support frame including ground engaging means and an upwardly spaced pivot location. A pivoting frame is mounted at the pivot location, and a sled is slidably mounted on the frame. The sled defines a support area whereby a person exercising can be positioned on the equipment. Means are engageable by the person to move the sled relative to the frame, and there are means for maintaining the pivoting frame at a selected angle relative to the support frame. There is a motor-driven means for changing said angle.

14 Claims, 7 Drawing Sheets

10
12
14
16
18
20
22
24
26
27
28
30
32
36
38
40
42
44
58
68
70
72
74

EXERCISE EQUIPMENT

BACKGROUND OF THE INVENTION

This invention relates to exercising equipment and, in particular, to equipment characterized by great versatility. Specifically, the equipment is capable of simulating very distinct exercise routines such as weight lifting and rowing thereby making it unnecessary to use multiple pieces of equipment for these purposes.

There are a wide variety of available exercise devices. Simple weights have been used, and weight lifting machines have been designed to accomplish this routine in a more controlled fashion.

As a result of various scientific studies, it has been determined that more beneficial exercise can be accomplished by focusing on more than weight training. As a result, various additional types of equipment were designed for simulating activity such as walking, jogging, bicycling, rowing and skiing. Understandably, however, a good deal of expense and substantial space requirements would be involved if an individual desired to have the weight training and other equipment available. This has led to the use of health clubs and the like where all the equipment can be maintained, but this adds an element of distinct inconvenience.

Some attempts have been made to combine features of various types of equipment so that cost and space requirements for individuals wishing to have their own equipment can be reduced. Examples of such equipment are disclosed in U.S. Pat. Nos. 4,272,074 and 4,706,953. Such equipment has been found undesirable, however, since the desired level of versatility has still not been achieved and since the mechanical operation is not satisfactory.

SUMMARY OF THE INVENTION

The exercise equipment of this invention consists of a stationary support frame including ground engaging means. A separate frame is pivotally connected to the stationary support frame, and the user of the equipment positions his or her self on this pivoting frame. More specifically, a sled for supporting the user is movably located on the pivoting frame, and the user moves this sled along the pivoting frame when the equipment is in use.

Means are provided to fix the pivoting frame in position relative to the support frame. Accordingly, the user determines the appropriate relative positions of the frames and this will determine the form of exercise which the user will then encounter. For example, in extreme positions, the influence of gravity will require substantial effort to achieve movement of the sled relative to the frame particularly where the sled is weighted. Substantial force generated with the user's arms and/or legs will be required.

If the pivoting frame is in an intermediate position, less effort will be required to move the sled. In this case, however, other exercise movement, such as a rowing movement, can be simulated. Furthermore, the pivoting frame is preferably controlled through operation of a gear motor which will fix the location of this frame at any desired angular position. It is also contemplated that the motor will be controllable while the user is positioned on the equipment so that various forms of exercise are achievable without the need for the user to get off to adjust the equipment.

DESCRIPTION OF THE PREFERRED EMBODIMENT

Figure 1:
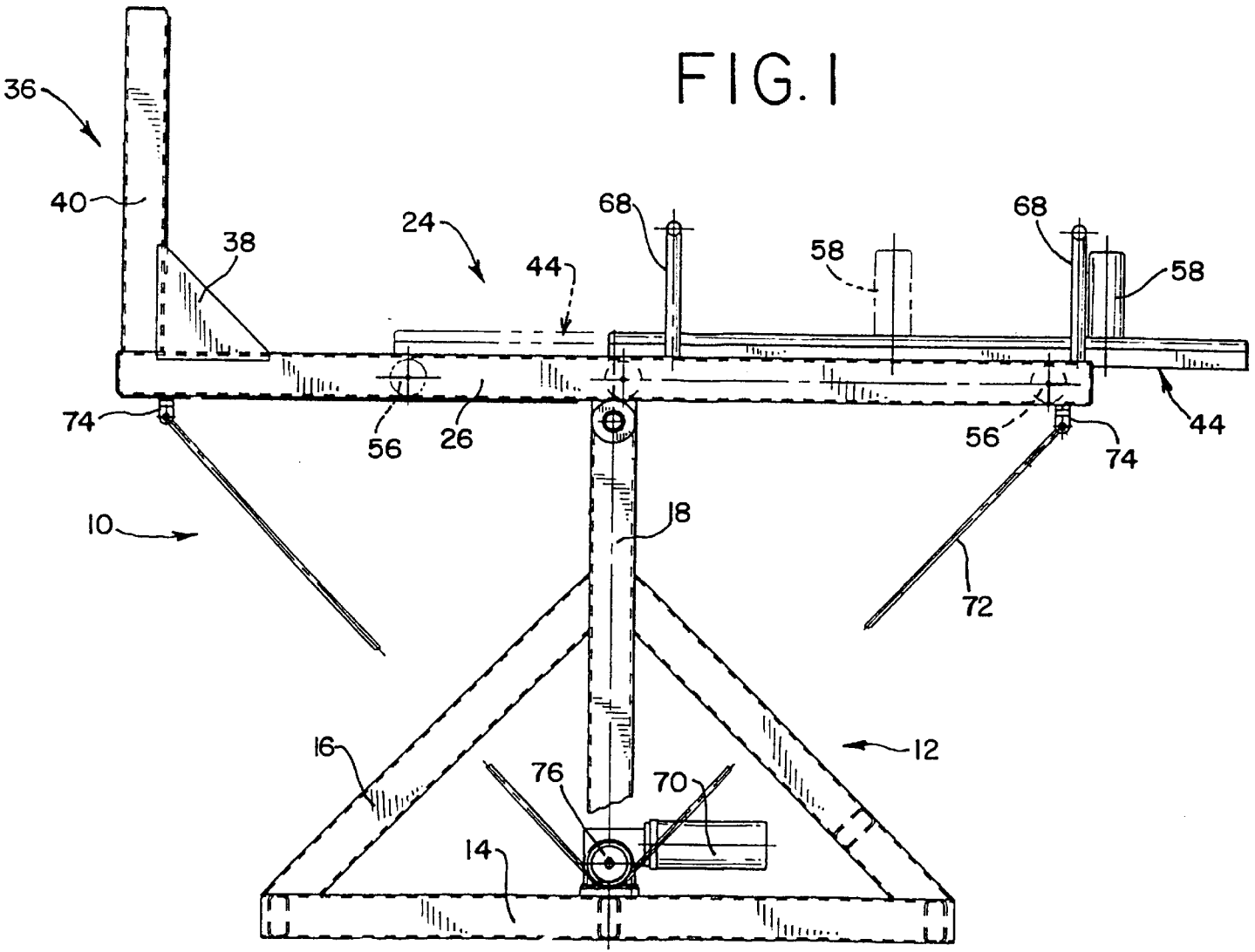
FIG. 1 is a side elevational view of the exercise equipment of the invention.

The exercise equipment 10 shown in the drawings comprises a support frame 12 consisting of a pair of side portions each made up of transverse members 14, angular members 16, and vertical members 18. Horizontal members 20 tie the side portions together.

Figures 3, 3A, 5, 6:
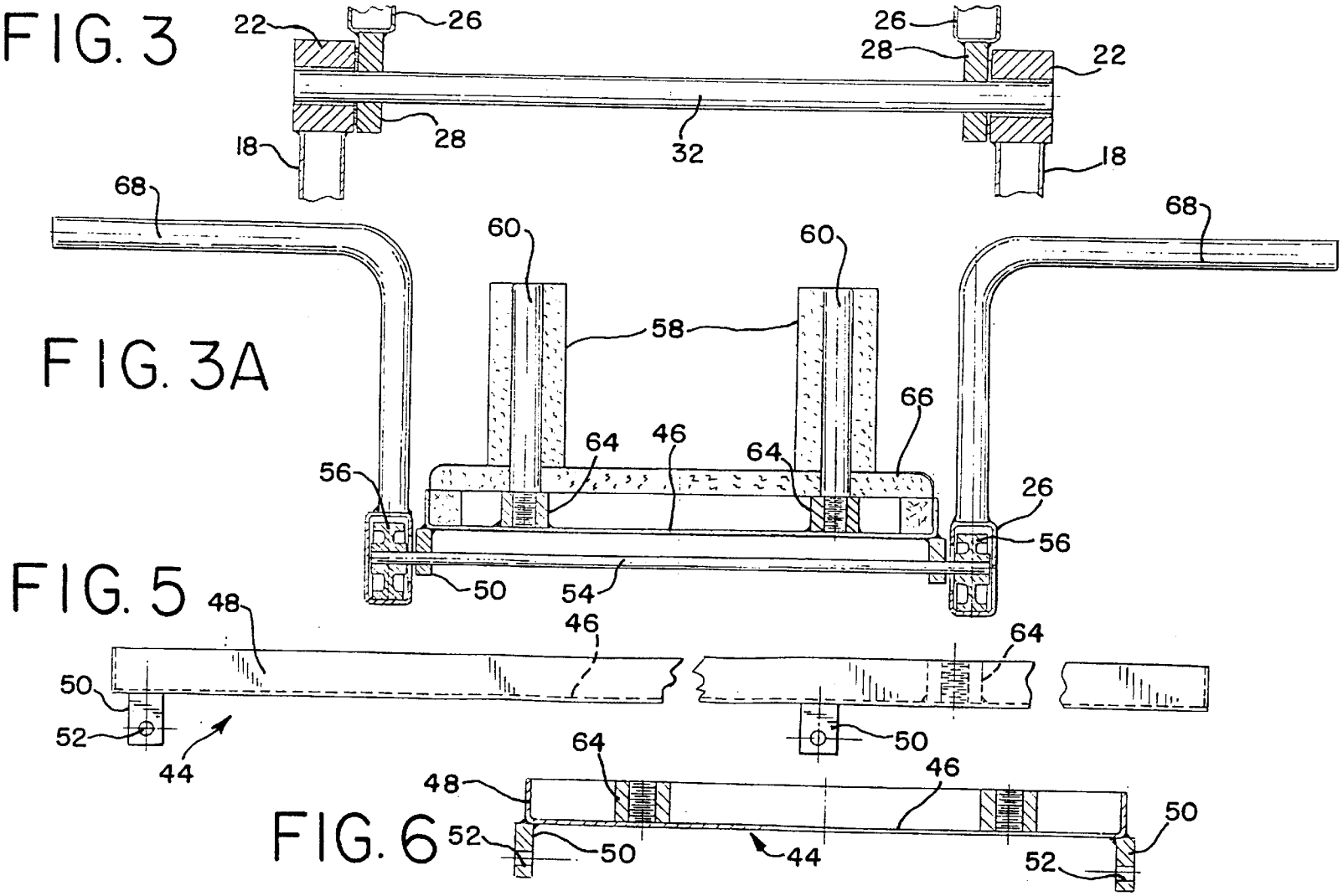
FIG. 3 is an enlarged fragmentary view illustrating the connection between the support frame and the pivoting frame.
FIG. 3A is a cross-sectional view of the pivoting frame and associated sled.
FIG. 5 is a fragmentary side elevational view of the sled.
FIG. 6 is a cross-sectional view of the sled.

A bearing support member 22 is mounted at the top of each vertical member 18. Pivoting frame 24 includes side rails 26 and transversely extending bottom plates 27 located at each end to tie the side rails together. Members 28 extend from the side rails for positioning adjacent bearing support members 22 (FIG. 3). Bores 30 in the members 28 are thus aligned with bores 32 of the bearing support members 22 and pivot rod 34 holds these members 28 and 22 in assembly while permitting relative pivoting movement of the frame 24 and support 12.

The pivoting frame 24 also includes a foot rest assembly 36 extending between side rails 26 and attached at one end by means of triangular plates 38. The assembly includes post members 40 and a platform 42 extending between the post members for engagement with the user's feet.

The pivoting frame also supports a movable sled assembly 44 shown in FIGS. 5 and 6. This assembly includes a bed 46 defining upstanding side walls 48. Depending posts 50 are attached to the side walls and openings 52 are defined by each post. As best shown in FIG. 3A, these openings receive rod 54 which has wheels 56 supported at the ends thereof. The wheels 56 ride within the confines of pivoting frame rails 26 and a set of wheels is positioned at each end of the sled assembly. This arrangement enables the user to move the sled relative to the pivoting frame.

The sled, as shown in FIGS. 1 and 3A, includes outwardly extending shoulder supports comprising cylindrical resilient pads 58. These pads are secured around posts 60 which have threaded ends 62 received in the fittings 64 attached to bed 46 of the sled. A transverse padded support 66 extends over the top of the bed to form the surface engaged by the user's back.

The side rails 26 of the pivoting frame 24 have hand grips 68 attached at spaced locations. Specifically, one set is located at the end opposite foot platform 42 and the other set adjacent the pivot point of this frame relative to support frame 12. As will be apparent, the hand grips may be used alternatively for achieving movement of the sled relative to the pivoting frame.

Figures 2, 4, 7:
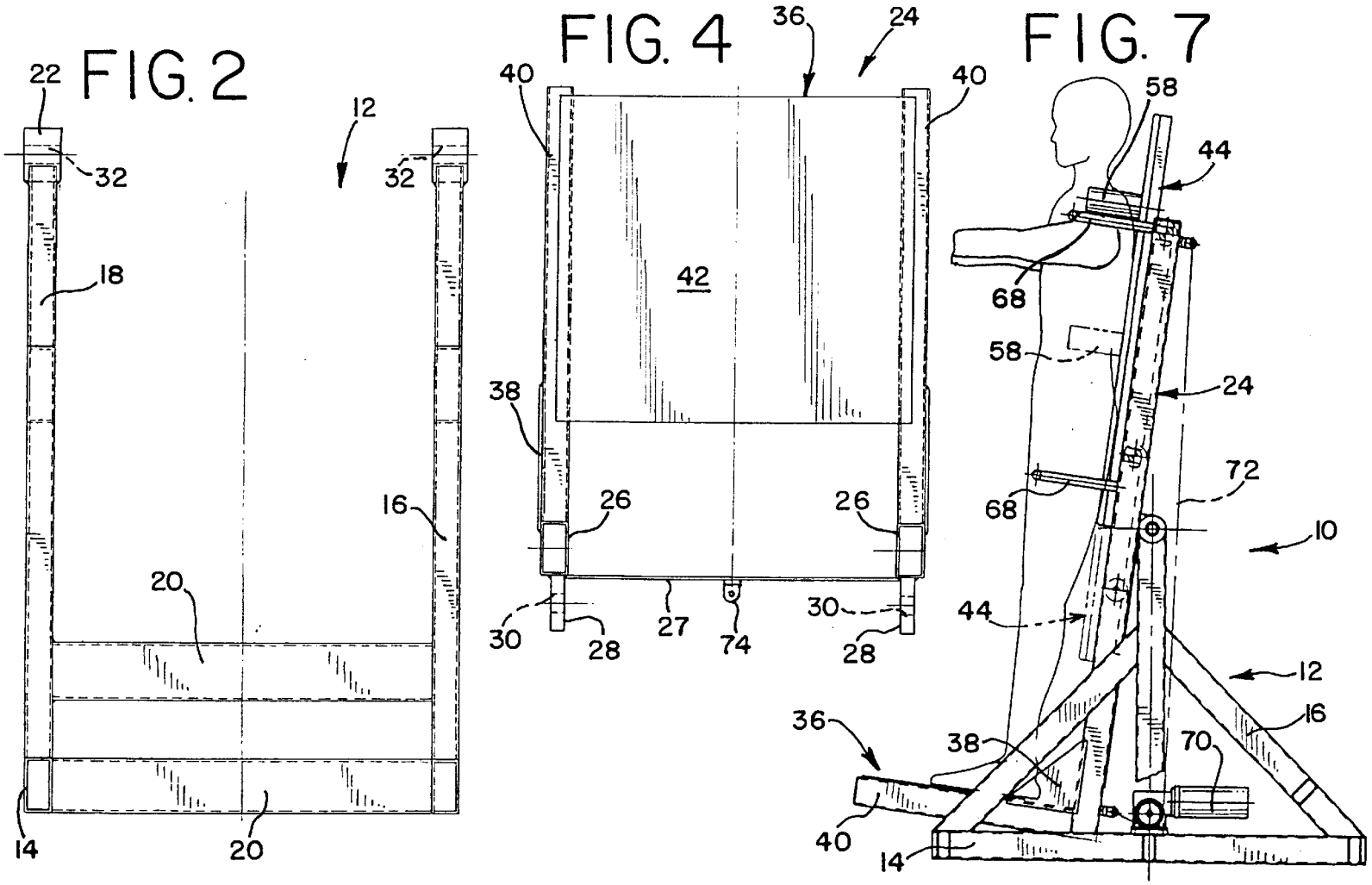
FIG. 2 is a front elevational view of the support frame for the equipment.
FIG. 4 is an end view of the pivoting frame with associated foot rest.
FIG. 7 is a side elevational view of the equipment showing the pivoting frame in one extreme position.
Figure 9:
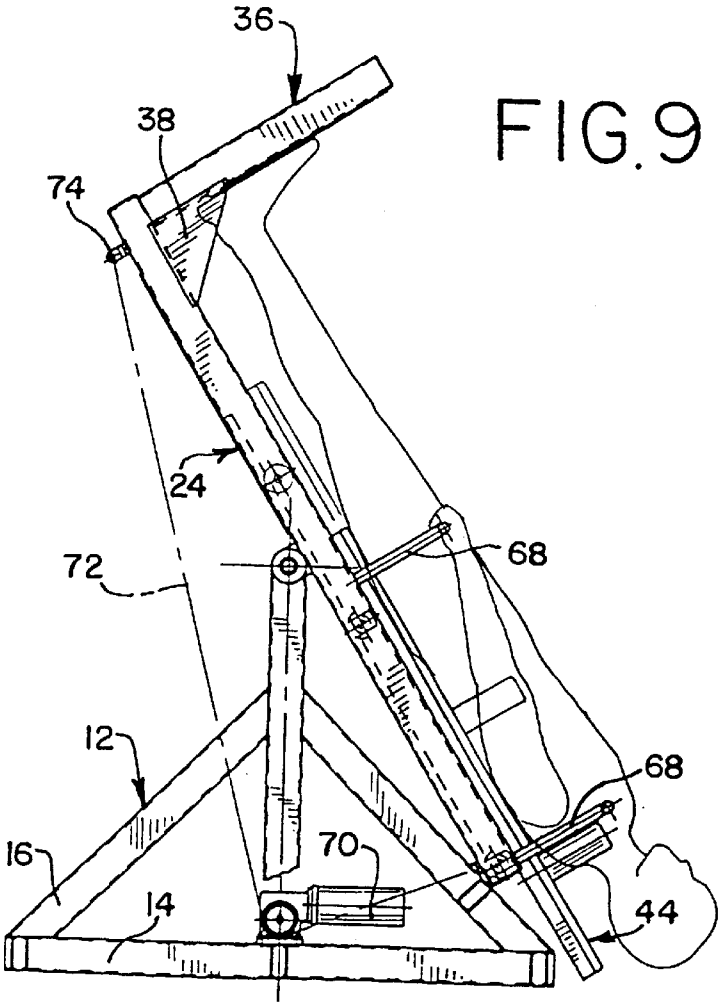
FIG. 9 is a side elevational view showing the pivoting frame in the opposite extreme position.
Figure 8:
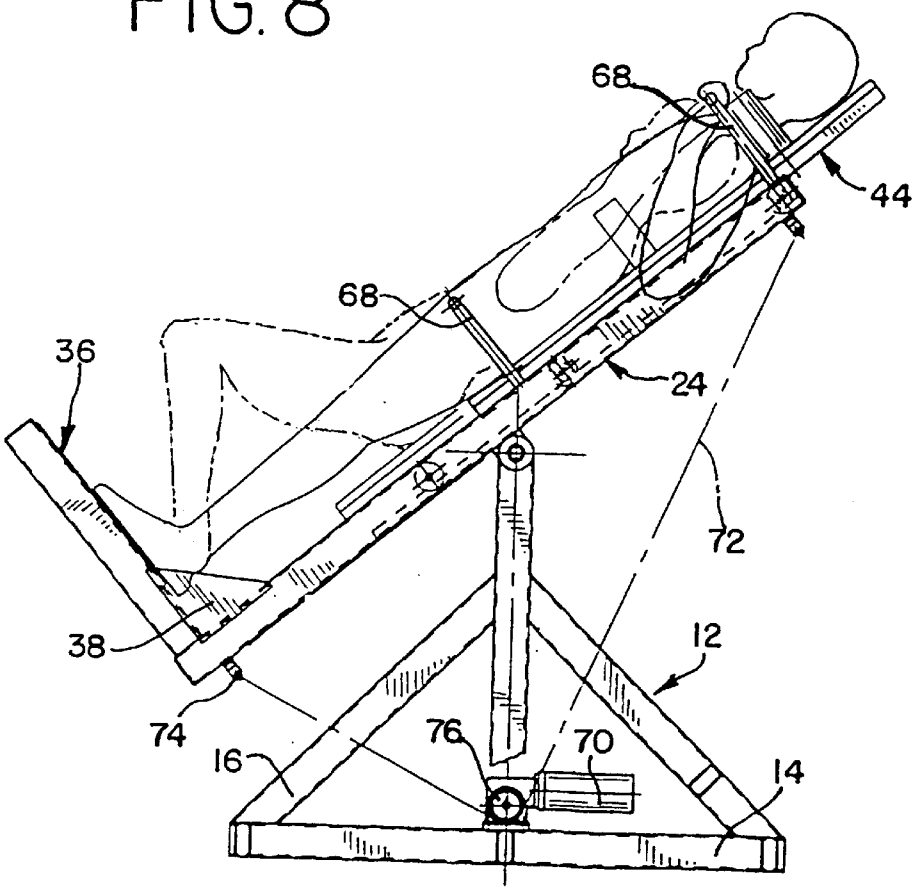
FIG. 8 is a side elevational view showing the pivoting frame in an intermediate position.

As illustrated in FIGS. 7 through 9, the apparatus of the invention is adapted for use in various positions. To achieve this, a motor 70 is mounted on support frame 12 and flexible metal cable 72 is driven by the motor. The opposite ends of the cable are attached to brackets 74 which are mounted to the bottom plates 27 on the underside of pivoting frame 24.

In a preferred form of the invention, the motor 70 comprises a gear motor such as a Leeson ¼ horsepower DC motor. The spindle and pulley assembly 76 driven by the motor automatically locks in position whenever the motor is stopped. Accordingly, when operated at relatively slow speed, the user can adjust the equipment to any desired angular relationship between the positions shown in FIGS. 7 and 9. Preferably, a hand-held control will be employed so that the adjustment takes place after the equipment is mounted by the user and so that a safe position for dismounting can be attained when the exercise routine is completed. In this same regard, it is contemplated that straps, such as for the waist area, be available so that the user can be secured when in certain positions.

Figure 10:
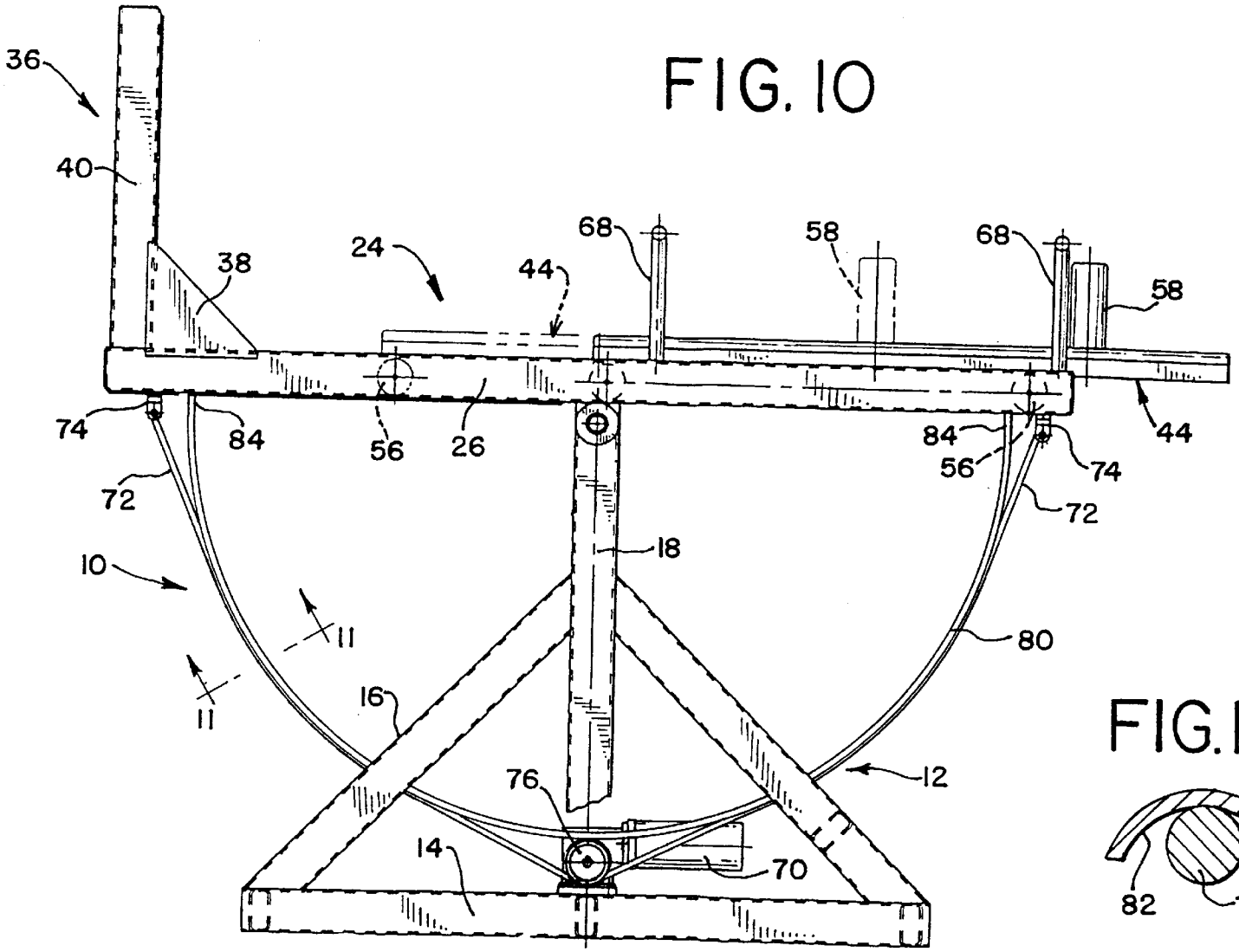
FIG. 10 is a side elevational view of a modified form of the invention including a cable guide means.
Figure 11:
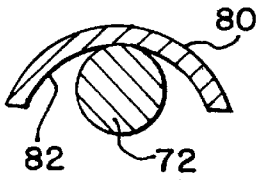
FIG. 11 is an enlarged cross-sectional view taken about the line 11—11 of FIG. 10.

FIGS. 10 and 11 illustrate a modified form of the invention shown in FIG. 1. Specifically, a guide 80 defines a channel 82 receiving cable 72. The guide has its ends 84 attached to the respective bottom plates 27 and the guide extends downwardly to the vicinity of motor 76. This arrangement insures against slack occurring in the cable particularly in the extreme positions of pivoting frame 24.

Figure 12:
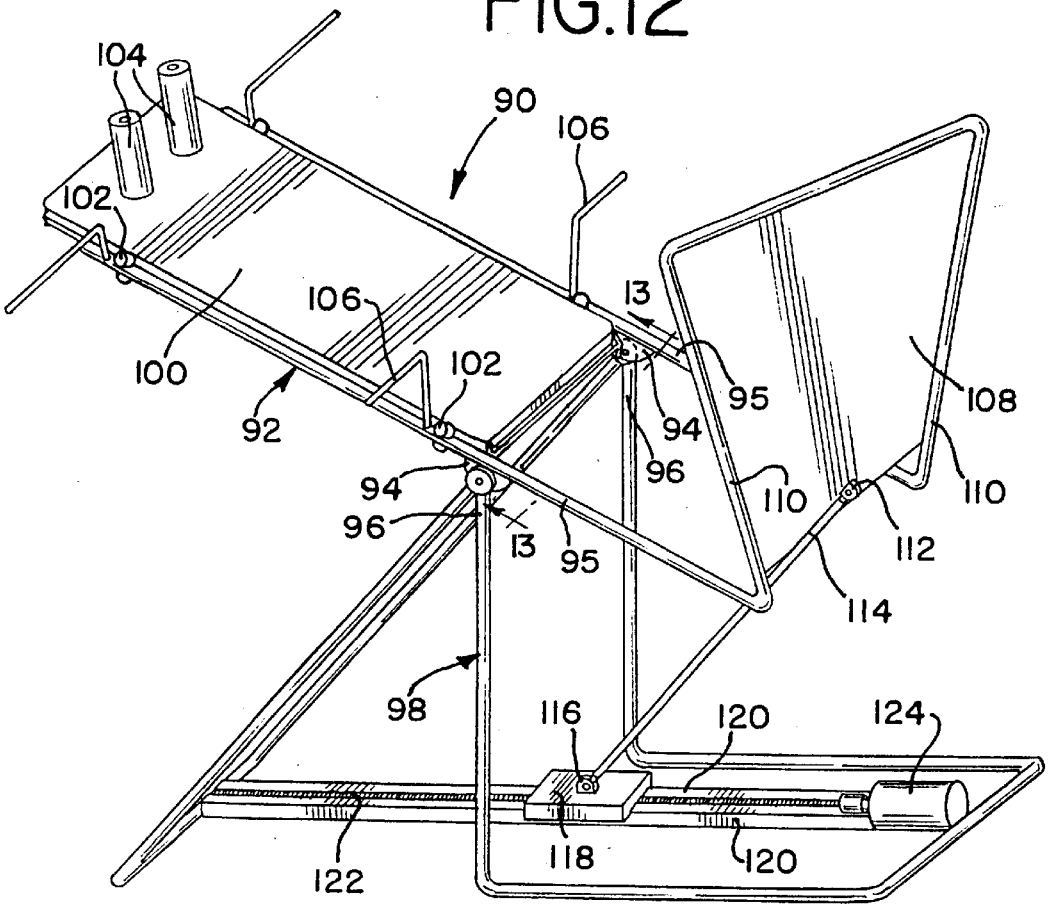
FIG. 12 is a perspective view of a further modified form of the invention employing a screw drive mechanism.
Figure 13:
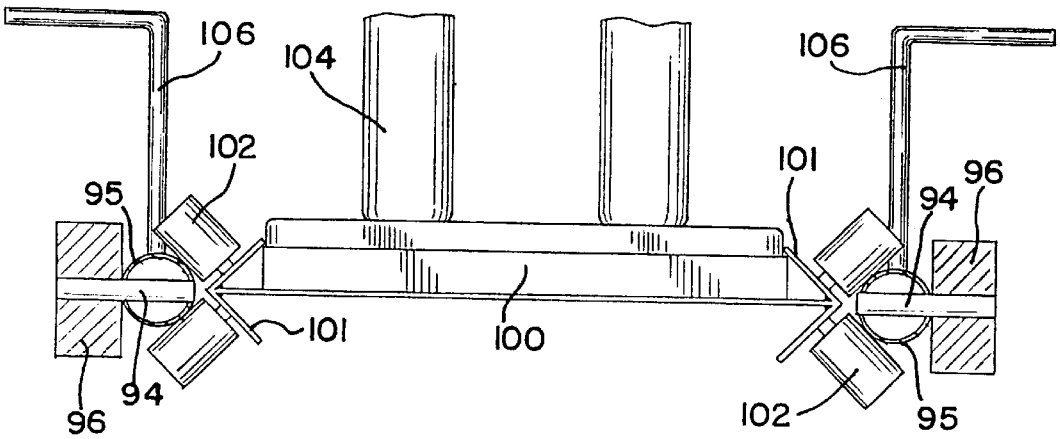
FIG. 13 is an enlarged detailed cross-sectional view taken about the line 13—13 of FIG. 12 illustrating the roller support structure for the sled shown in FIG. 12.

FIGS. 12 and 13 illustrate a further modified form of the invention comprising an exercise device 90 having pivoting frame 92. This frame carries pins 94 which are attached to frame side pieces 95 and which are pivotally supported within bearings 96 mounted at the upper ends of support frame 98. The frames 92 and 98 are preferably formed of round steel tubing.

A movable sled 100 is supported on the frame 92. As shown in FIG. 13, the pins 94 are fixed on the outboard side of side pieces 95 to provide space for movement of rollers 102. These rollers 102 are supported on each side of the sled 100 and at each end by angle pieces 101 for engagement with upper and lower surfaces of side pieces 95 to thereby permit relative longitudinal movement of the sled while holding the sled in place.

Shoulder rests 104 are fixed to the sled and hand grips 106 are fixed to the side pieces. Platform 108 extends between angular extensions 110 of the side pieces. The extensions 110 are positioned in a plane at a right angle to the plane of the side pieces 95. These extensions extend at an angle to the side pieces, however, so that the space between the extensions increases gradually in the outward direction. Accordingly, the platform 108 has a wider outer end.

Fixture 112 is supported on the bottom side of platform 108 and a stiff rod 114 extends between this fixture and fixture 116. The latter is supported on block 118, and this fixture, as well as the fixture 112, provides pivotal support for the rod 114.

The block 118 fits around spaced apart rails 120 for sliding movement of the block relative to the rails. A drive screw 122 is in threaded engagement with the block and motor 124 drives this screw. As will be apparent, rotation of the screw will change the position of block 118 to thereby change the angular relationship of the frames 92 and 98. Accordingly, the exercise device 90 is adapted to achieve a variety of workout positions. Furthermore, the drive screw arrangement will automatically lock the angular relationship in a chosen position by using a gear motor as described.

Figure 14:
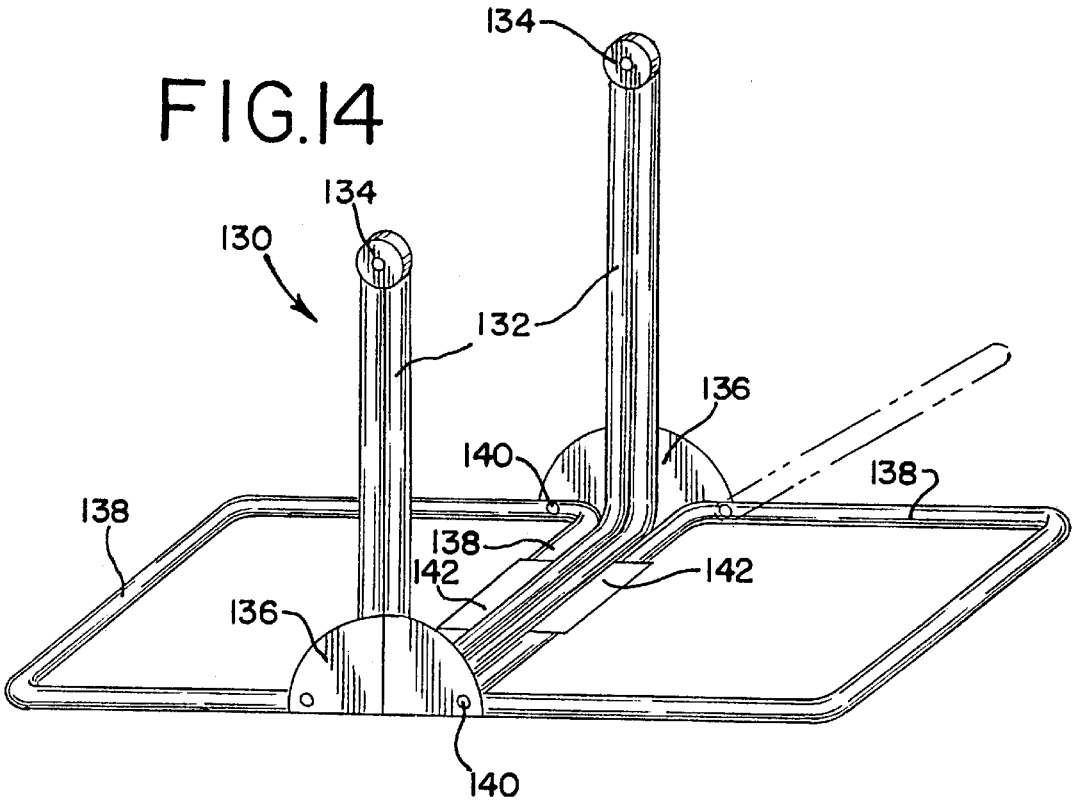
FIG. 14 is a perspective view of a further alternative form of the invention comprising a collapsible support frame.

FIG. 14 illustrates an alternative form 130 of support frame which may be substituted for the frames shown in FIGS. 1 and 12. The uprights 132 are formed of a pair of welded together tubing pieces and pivot supports 134 are attached at the tops thereof. Quarter circle plates 136 are attached at the lower ends of the uprights.

Horizontally extending rectangular tubing pieces 138 are pivotally attached at 140 to the plates 136. The interior cross members of the tubing pieces 138 support plates 142 which in turn support a motor such as shown in FIG. 1 or rails 120 as shown in FIG. 12. When in place, these components for controlling the movement of a pivoting frame will lock the tubing pieces 138 in the horizontal position. When removed, the tubing pieces may be pivoted about plates 136 so that a compact frame, suitable for transportation and storage, is provided.

Figure 15:
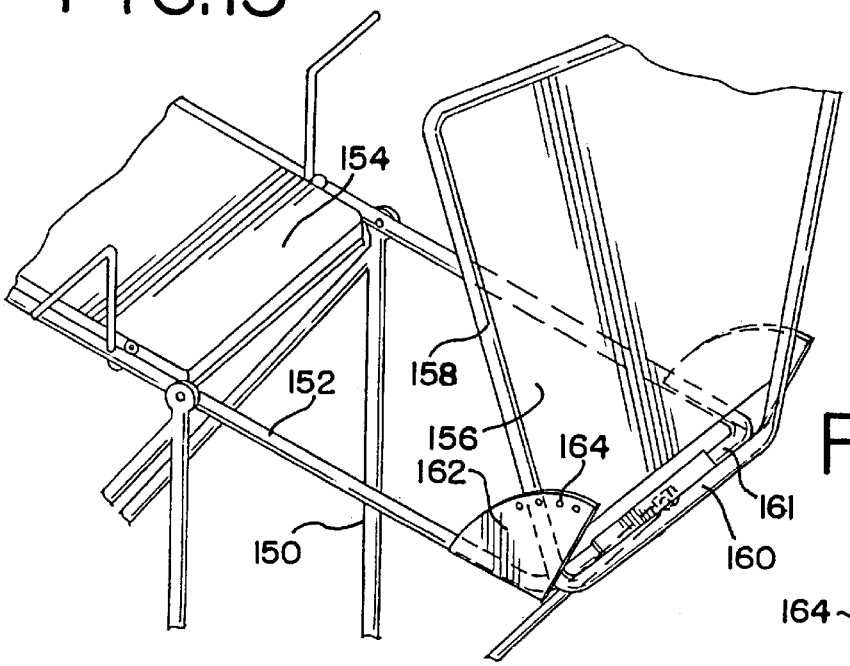
FIG. 15 is a fragmentary perspective view of the pivoting frame with an adjustable platform.
Figure 15A:
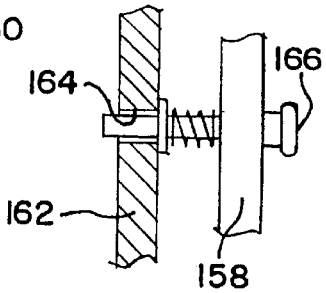
FIG. 15A is a fragmentary cross-sectional view of the spring lock.

FIG. 15 illustrates a support frame 150, pivoting frame 152 and sled 154 of the general type shown in FIG. 12. In this case, the platform 156 is attached to a frame 158 made of tubing, and the cross member 160 of the frame 158 is hinged to the cross member 161 of pivoting frame 152. Plates 162 are attached to frame 152 and openings 164 in the plates receive spring loaded pins 166 carried by the frame 158 (FIG. 15A). In this fashion, the platform 156 can be located in a plurality of different positions to further increase the versatility of the apparatus.

The equipment in each of the forms described is advantageous from the standpoint of great versatility. In one sense, weight lifting is achieved since movement of the sled assembly requires input from the user and it will be appreciated that the degree of effort required is determined by the angular relationship of the respective frames. Thus, the influence of gravity can be increased or decreased. In addition, the weight of the sled assembly can be varied by providing, for example, the ability to add or subtract weight within the space provided by bed 46 and side walls 48.

Versatility is also provided in the sense that types of exercising apart from weight lifting are achievable. For example, when the equipment is positioned with the pivoting frame at or near the horizontal, the user can sit on the sled assembly and, using the centrally located hand grips, simulate a rowing action. Using the shoulder rests and the upper hand grips 68, the user could also use the equipment while facing the sled assembly and lifting in this fashion. Chin-ups (LAT pulls), chest presses and leg squats are among the specific exercise possibilities.

It will be understood that various changes may be made in the equipment described without departing from the spirit of the invention particularly as described in the following claims.

That which is claimed is:

1. Exercise equipment comprising a stationary support frame including floor engaging means and an upwardly spaced pivot location, a pivoting frame mounted at said pivot location, a sled slidably mounted on said frame, said sled defining a support area whereby a person exercising can be positioned on the equipment, means engageable by the person to move the sled relative to the frame, means maintaining the pivoting frame at a selected angle relative to the support frame, a motor-driven means for changing said angle, and wherein said pivoting frame includes a longitudinal potion supporting said sled, and a transverse portion situated at one end of the pivoting frame, said transverse portion serving as a foot rest for the person exercising and comprising part of the means to move the sled relative to the pivoting frame.

2. Exercise equipment according to claim 1 including shoulder rests extending transversely from adjacent the end of said sled most remote from said foot rest whereby the person exercising can move said sled relative to said pivoting frame by pressing the feet against the foot rest and pressing the shoulders against the shoulder rests.

3. Exercise equipment according to claim 1 wherein said pivoting frame includes opposed side rails, said sled carrying wheels supported by said rails for facilitating movement of the sled.

4. Exercise equipment comprising a stationary support frame including floor engaging means and an upwardly spaced pivot location, a pivoting frame mounted at said pivot location, a sled slidably mounted on said frame, said sled defining a support area whereby a person exercising can be positioned on the equipment, means engageable by the person to move the sled relative to the frame, means maintaining the pivoting frame at a selected angle relative to the support frame, a motor-driven means for changing said angle, and wherein said means to move the sled relative to the pivoting frame include hand grips supported on said pivoting frame.

5. Exercise equipment according to claim 4 wherein said hand grips include a first set of grips located on opposite sides of the pivoting frame adjacent a first end remote from said pivot location, and a second set of grips located adjacent said pivot location.

6. Exercise equipment according to claim 5 wherein said pivoting frame includes a longitudinal portion supporting said sled, and a transverse portion situated at one end of the pivoting frame, said transverse portion serving as a foot rest for the person exercising and comprising part of the means to move the sled relative to the pivoting frame.

7. Exercise equipment according to claim 6 including shoulder rests extending transversely from adjacent the end of said sled most remote from said foot rest whereby the person exercising can move said sled relative to said pivoting frame by pressing the feet against the foot rest and pressing the shoulders against the shoulder rest.

8. Exercise equipment comprising a stationary support frame including floor engaging means and an upwardly spaced pivot location, a pivoting frame mounted at said pivot location, a sled slidably mounted on said frame, said sled defining a support area whereby a person exercising can be positioned on the equipment, means engageable by the person to move the sled relative to the frame, means maintaining the pivoting frame at a selected angle relative to the support frame, a motor-driven means for changing said angle, and including a cable attached at opposite ends of said pivoting frame, a gear motor operatively attached to said cable, stopping of said gear motor operating to lock said pivoting frame in a desired angular position relative to said support frame.

9. Exercise equipment according to claim 8 including a guide attached at each end of said pivoting frame and extending downwardly adjacent the support frame, said cable being supported by said guide.

10. Exercise equipment according to claim 9 including members extending downwardly from said rails providing a pivot connection to said support frame.

11. Exercise equipment according to claim 4 wherein said support frame includes a vertically extending support with said pivot location at the top end thereof, said floor engaging means extending horizontally outwardly from the bottom end of the vertically extending support, and means pivotally attaching said floor engaging means adjacent said bottom end whereby the support frame can be folded.

12. Exercise equipment comprising a stationary support frame including floor engaging means and an upwardly spaced pivot location, a pivoting frame mounted at said pivot location, a sled slidably mounted on said frame, said sled defining a support area whereby a person exercising can be positioned on the equipment, means engageable by the person to move the sled relative to the frame, means maintaining the pivoting frame at a selected angle relative to the support frame, a motor-driven means for changing said angle, and wherein said pivoting frame includes opposed side rails, said sled carrying wheels supported by said rails for facilitating movement of the sled.

13. Exercise equipment comprising a stationary support frame including floor engaging means and an upwardly spaced pivot location, a pivoting frame mounted at said pivot location, a sled slidably mounted on said frame, said sled defining a support area whereby a person exercising can be positioned on the equipment, means engageable by the person to move the sled relative to the frame, means maintaining the pivoting frame at a selected angle relative to the support frame, a motor-driven means for changing said angle, and including a rod extending between said pivoting frame and said support frame, a sliding block attached at one end of said rod, said motor driven means moving said sliding block relative to said support frame for changing said angle.

14. Exercise equipment according to claim 8 including a drive screw operatively attached to said block, and a gear motor for rotating said screw to achieve movement of said 1 block.

* * * * *